US008264442B2

(12) United States Patent
Ooga et al.

(10) Patent No.: US 8,264,442 B2
(45) Date of Patent: Sep. 11, 2012

(54) DRIVING METHOD AND DRIVING DEVICE FOR DISPLAYING PANEL UTILIZING PARALLEL DRIVEN DRIVE CONTROLLERS

(75) Inventors: Kouichi Ooga, Kanagawa (JP); Tsuyoshi Ichiraku, Kanagawa (JP)

(73) Assignee: NLT Technologies, Ltd., Kanagawa (JP)

( * ) Notice: Subject to any disclaimer, the term of this patent is extended or adjusted under 35 U.S.C. 154(b) by 1221 days.

(21) Appl. No.: 11/366,493

(22) Filed: Mar. 3, 2006

(65) Prior Publication Data

US 2006/0197730 A1 Sep. 7, 2006

(30) Foreign Application Priority Data

Mar. 4, 2005 (JP) ..... 2005-061670

(51) Int. Cl.
*G09G 3/36* (2006.01)

(52) U.S. Cl. ..... 345/99

(58) Field of Classification Search ..... 345/1.1–3.4, 345/98–99

See application file for complete search history.

(56) References Cited

U.S. PATENT DOCUMENTS

| | | | | |
|---|---|---|---|---|
| 2001/0003447 | A1* | 6/2001 | Murai et al. | 345/99 |
| 2002/0030686 | A1* | 3/2002 | Sakai et al. | 345/531 |
| 2002/0060655 | A1* | 5/2002 | Moon | 345/87 |
| 2002/0067318 | A1* | 6/2002 | Matsuzaki et al. | 345/1.1 |
| 2003/0184550 | A1* | 10/2003 | Nally | 345/531 |
| 2004/0150581 | A1* | 8/2004 | Westerinen et al. | 345/1.3 |
| 2005/0156810 | A1* | 7/2005 | Zerphy et al. | 345/1.1 |

FOREIGN PATENT DOCUMENTS

| | | |
|---|---|---|
| JP | 6-102851 | 4/1994 |
| JP | 2001-092424 | 4/2001 |
| JP | 2001-272961 | 10/2001 |
| JP | 2001-318657 | 11/2001 |
| JP | 2002-196733 | 7/2002 |
| JP | 2002-311913 | 10/2002 |
| JP | 2003-044029 | 2/2003 |
| JP | 2004-309986 | 11/2004 |
| JP | 2004-361457 | 12/2004 |
| JP | 2005-517997 | 6/2005 |

OTHER PUBLICATIONS

Japanese Patent Office issued a Japanese Office Action dated May 11, 2010, Application No. 2005-061670.

* cited by examiner

*Primary Examiner* — Chanh Nguyen
*Assistant Examiner* — Robert Stone
(74) *Attorney, Agent, or Firm* — Young & Thompson

(57) ABSTRACT

A method of driving a display panel is provided which is capable of restoring normal operation to a timing controller in which an abnormality in display control has occurred. When a signal detecting section of one timing controller detects an abnormality that no signal is input or that a supply of a clock signal is stopped, the detected result is transferred from a two-way communicating section of the one timing controller to a two-way communicating section of the other timing controller. The other timing controller having received the detected result transfers a normal image signal and/or clock signal from the two-way communicating section of the other timing controller to the two-way communicating section of the one timing controller. The one timing controller exerts display control of a liquid crystal display panel according to the transferred image signal and/or clock signal.

17 Claims, 5 Drawing Sheets

DRIVING METHOD AND DRIVING DEVICE FOR DISPLAYING PANEL UTILIZING PARALLEL DRIVEN DRIVE CONTROLLERS

BACKGROUND OF THE INVENTION

1. Field of the Invention

The present invention relates to a driving method and a driving device for driving a display panel, and more particularly to the driving method and the driving device for driving the display panel which, when a liquid crystal display panel or a like is to be driven by using a plurality of timing controllers, put the driving being performed by one timing controller, for example, driving to be performed at time of the occurrence of an abnormality in display control, under control of any one of other timing controllers.

The present application claims priority of Japanese Patent Application No. 2005-061670 filed on Mar. 4, 2005, which is hereby incorporated by reference.

2. Description of the Related Art

In a conventional liquid crystal display device (hereinafter, referred to as a "known liquid crystal display device"), in order to achieve its displaying at high resolution, a technological method is generally employed in which two timing controllers are used for driving a liquid crystal display panel and a frequency of a dot clock signal is lowered. The known liquid crystal display device, as shown in FIG. 5, is so constructed that timing controllers 112 and 114 receive input image signals from corresponding signal inputting sections 24 and 26 respectively and supply signals for display control to corresponding source drivers 30, 32, 34, and 36 which drive a liquid crystal display panel (not shown) to display images corresponding to the input image signals on a screen of the liquid crystal display panel. In the known liquid crystal display device, when no signal is input to one timing controller, signals output from the one timing controller are not supplied to a driving circuit of a liquid crystal display panel. As a result, only a DC (Direct Current) component is applied to the liquid crystal display panel.

Also, technology is disclosed in Patent Reference 1 (Japanese Patent Application Laid-open No. 2001-272961) in which an abnormality in signals to be transferred from a display controlling section to a flat display body module in a flat display device, more particularly, in a liquid crystal display device, for example, the abnormality of stopping of a supply of a clock signal is detected and, based on the detected result, a form of the signal to be transferred to the flat display body module is changed, for example, a supply of a voltage among liquid crystal electrodes is stopped, that is, the voltage is reduced to zero.

Also, examples of methods for solving technological problems in a controller used in a driving method of a conventional liquid crystal display device are described in Patent Reference 2 (Japanese Patent Application Laid-open No. 2002-311913). That is, in the controller used in the driving method of the conventional liquid crystal display device, an interface is provided in which display data for one port is divided into display data for two ports and a liquid crystal display panel is driven by using the display data divided by the interface. However, in this case, following technological problems arise. In the above controller, a large constraint is placed on a data format to be transmitted to a liquid crystal display device from a transmitter of the data, in other words, a constraint is placed on freedom of a signal form of display data, which causes a constraint on freedom of circuit design and which leads, as a result, to complication, high pricing, or a like of the liquid crystal display device.

To solve the above technological problems, the liquid crystal display device disclosed in the Patent Reference 2 is constructed so as to have timing controllers to drive two groups of drivers which supply display digital data corresponding to 2N ports (N is a natural number) of the liquid crystal display panel when the liquid crystal display panel having a screen divided into a left half and a right half is driven and each of the timing controllers is made up of a data supplying circuit which supplies the first display digital data divided as time-series data or 2N-port second display digital data divided as data for a left half and as data for a right half of the screen corresponding to each different port, to each of the above 2N ports, of a memory circuit having a memory mounted between the data supplying circuit and the above two groups of drivers which writes the first display digital data supplied and reads the data as the second display digital data for 2N ports, and of an input selecting circuit to supply the above second display digital data selected out of the above first display digital data and the above second display digital data to be fed from the data supplying circuit to the above groups of drivers.

Moreover, a plural-screen display device is disclosed in Patent Reference 3 (Japanese Patent Application Laid-open No. Hei 6-102851) in which a screen is divided into a plurality of portions for being displayed. In the plural-screen display device, technological problems associated with ganged scrolling over the divided screens (hereafter called "partial screens"), movement of a cursor among partial screens, and improvement of operability are expected to be solved. To solve the problems technologically, the plural-screen display device is constructed so that display data corresponding to each of the partial screens is stored in a screen memory in a manner to correspond to the partial screens and, when a request for updating of the display data corresponding to the partial screen is made, a screen creating means can update the corresponding display data stored in the screen memory to display data for requested updating and, when a screen display instruction is input, a display data fetching means reads individually the display data for the partial screen and feeds the read display data to a screen display means corresponding to the partial screen and the screen display means corresponding to the partial screen to individually receive the display data for the partial screen performs processing of displaying the partial screen on a screen.

Also, a liquid crystal display device is disclosed in Patent Reference 4 (Japanese Patent Application Laid-open No. 2002-196733) in which a screen is divided into a plurality of portions for being displayed, as in the case of the Patent Reference 3. The liquid crystal display device uses an FPC (Flexible Printed Cable) to transmit image data to drive a liquid crystal display panel and various control signals. However, the FPC has technological problems. That is, as a frequency of a signal increases, signal coupling, noise, electromagnetic coupling, signal delay, signal distortion, or a like occurring in a transmission path of the FPC increase.

To solve these problems technologically, a timing controller is mounted for every source driver to individually drive a left half and right half of a liquid crystal display panel in a place close to each of the source drivers and an output signal of each timing driver is supplied to corresponding source drivers to drive the liquid crystal display panel. By configuring as above, the problems of signal delay and signal distortion occurring on the transmission path of the FPC are expected to be solved.

However, each of the above conventional technologies has problems. That is, in the case of the known liquid crystal display device described above, when no signal is input to one timing controller, an abnormality in display control occurs in the one timing controller and a supply of a signal output from the one timing controller to the driving circuit of the liquid crystal display panel is stopped. As a result, in this state, not only an abnormality in display occurs in the liquid crystal display device but also only the DC component is applied to the liquid crystal display panel, resulting in deterioration of the liquid crystal display panel. Moreover, no suggestion is provided about technological driving cooperation between one timing controller and the other timing controller.

Also, according to the technology disclosed in the Patent Reference 1, when an abnormality in signals to be transferred from the display controlling section of the flat display device to the flat display body module is detected, a form of the signal to be transferred from the display controlling section to the flat display body module is changed, for example, a voltage among liquid crystal electrodes is reduced to zero, which can avoid application of a DC voltage to the flat display body, for example, to the liquid crystal display panel and can prevent the liquid crystal display panel from deteriorating. However, there is no description of the case where the plurality of timing controllers is used as in the case of the known liquid crystal display device.

Also, according to the technology disclosed in the Patent Reference 2, there are provided the data supplying circuit, the memory circuit mounted between the data supplying circuit and the above two groups of the drivers which has a memory to write the first display digital data supplied and to read the data as the second display digital data for 2N ports, and the input selecting circuit to select the second display digital data out of the first display digital data or second display digital data to be fed from the data supplying circuit and to supply the selected digital data to the groups of drivers and, therefore, the technology serves to solve technological problems caused by a signal form of display data to be input, however, the technological problems associated with the use of a plurality of timing controllers remain unsolved as in the case of the known liquid crystal display device described above.

Also, according to the technology disclosed in the Patent Reference 3, display data corresponding to partial screens stored in a screen memory in a manner to correspond to the partial screens, when a request for updating of the display data corresponding to the partial screens is made, can be updated to display data for requested updating by a screen creating means and, when a screen display instruction is input, the display data for the partial screens is read individually by the display data fetching means and is fed to a screen display means corresponding to the partial screens and the screen display means corresponding to the partial screens performs processing of displaying the partial screens on a screen by using the display data for the partial screens, which serves to provide smooth ganged scrolling over partial screens, smooth movement of a cursor among partial screens and improvement of operability. However, the technological problems associated with the use of a plurality of timing controllers remain unsolved as in the case of technologies disclosed in the above Patent References 1 and 2.

Furthermore, according to the technology disclosed in the Patent Reference 4, the timing controller is mounted for every source driver to individually drive a left half and right half of the liquid crystal display panel in a place close to each of the source drivers and an output signal of each timing driver is supplied to corresponding source drivers to drive the liquid crystal display panel and, therefore, the problems of signal delay and signal distortion occurring in the transmission path of the FPC when a single timing controller is used for display control in the liquid crystal display panel as the conventional case can be solved. However, the technological problems associated with the use of a plurality of timing controllers remain unsolved as in the case of technologies disclosed in the above Patent References 1, 2 and 3.

SUMMARY OF THE INVENTION

In view of the above, it is an object of the present invention to provide a driving method and a driving device for driving a display panel which are capable of putting, when a liquid crystal display panel or a like is to be driven by using a plurality of timing controllers, driving being performed by one timing controller under the control of the other timing controller.

According to a first aspect of the present invention, there is provided a driving method for driving a display panel by using a plurality of panel driving units including at least a first panel driving unit and a second panel driving unit, the method including:

transferring an image signal and/or a control signal to the first panel driving unit via the second panel driving unit, when any abnormality has occurred regarding inputting of the image signal and/or the control signal to the first panel driving unit; and making the first panel driving unit exert a driving control of the display panel based on the image signal and/or the control signal received via the second panel driving unit.

In the foregoing first aspect, a preferable mode is one wherein the display panel includes a liquid crystal display panel.

According to a second aspect of the present invention, there is provided a driving method for driving a display panel by using a plurality of panel driving units including at least a first panel driving unit and a second panel driving unit, the method including:

detecting any abnormality regarding inputting of an image signal and/or a control signal to the first panel driving unit, informing the second panel driving unit of the detected result via a connection line between the first panel driving unit and the second panel driving unit;

transferring the image signal and/or the control signal from the second panel driving unit to the first panel driving unit, in response to the informed detected result; and making the first panel driving unit exert a driving control of the display panel based on the image signal and/or the control signal transferred from the second panel driving unit.

In the foregoing second aspect, a preferable mode is one wherein the image signal and/or the control signal to be transferred from the second panel driving unit to the first panel driving unit is stored as data in a memory mounted on the second panel driving unit.

Also, a preferable mode is one wherein the image signal and/or the control signal to be transferred from the second panel driving unit to the first panel driving unit is a signal to make fixed display appear on the display panel.

Also, a preferable mode is one wherein the image signal and/or the control signal to be transferred from the second panel driving unit to the first panel driving unit is a signal to make black fixed display appear on the display panel.

According to a third aspect of the present invention, there is provided a driving device for driving a display panel by using a plurality of panel driving units including at least a first panel driving unit and a second panel driving unit, the device including:

a transferring unit adapted to transfer alternatively an image signal and/or a control signal from the second panel driving unit to the first panel driving unit, when any abnormality has occurred regarding inputting of the image signal and/or the control signal to the first panel driving unit; and wherein the first panel driving unit exerts a driving control of the display panel based on the image signal and/or the control signal received from the second panel driving unit via the transferring unit.

In the foregoing third aspect, a preferable mode is one wherein the display panel includes a liquid crystal display panel.

According to a fourth aspect of the present invention, there is provided a driving device for driving a display panel by using a plurality of panel driving units including at least a first panel driving unit and a second panel driving unit, the device including:

a detecting unit to detect any abnormality regarding inputting of a image signal and/or a control signal to the first panel driving unit, a first transferring unit adapted to transfer the result detected by the detecting unit from the first panel driving unit to the second panel driving unit; and a second transferring unit adapted to transfer alternatively the image signal and/or the control signal from the second panel driving unit to the first panel driving unit, in response to the transferred detected result, wherein the first panel driving unit exerts a driving control of the display panel based on the image signal and/or the control signal received from the second panel driving unit via the second transferring unit.

In the foregoing fourth aspect, a preferable mode is one that wherein further includes at least two signal inputting sections to input the image signal and/or the control signal to the first panel driving unit and the second panel driving unit.

Also, a preferable mode is one wherein the image signal and/or the control signal to be transferred from the second panel driving unit to the first panel driving unit is stored as data in a memory mounted on the second panel driving unit.

Also, a preferable mode is one wherein the image signal and/or the control signal to be transferred from the second panel driving unit to the first panel driving unit is a signal to make fixed display appear on the display panel.

Also, a preferable mode is one wherein the image signal and/or the control signal to be transferred from the second panel driving unit to the first panel driving unit is a signal to make black fixed display appear on the display panel.

Also, a preferable mode is one wherein the display panel includes a liquid crystal display panel.

Furthermore, a preferable mode is one wherein the panel driving unit includes a timing controller, the detecting unit includes a signal detecting section mounted on a first timing controller, the first transferring unit includes a two-way communicating section mounted on the first timing controller, and the second transferring unit includes a two-way communicating section mounted on a second timing controller.

With the above configuration, when a display panel is driven by a plurality of panel driving units, an abnormal signal for display control is transferred from a first panel driving unit which has detected the abnormality, out of the plurality of panel driving units, to a second panel driving unit which is exerting normal display control and the second panel driving unit makes the first panel driving unit exert normal display control according to a normal signal for display control transferred from the second panel driving unit and, therefore, the plurality of panel driving units can cooperate to normally drive the display panel. By applying the driving control method using such the cooperating driving units to driving control at time of the occurrence of an abnormality in display control, even when no image signal is input to the panel driving unit or a supply of a clock signal or a like is stopped, normal display control is made possible and deterioration of a display panel can be prevented.

BRIEF DESCRIPTION OF THE DRAWINGS

The above and other objects, advantages, and features of the present invention will be more apparent from the following description taken in conjunction with the accompanying drawings in which.

DETAILED DESCRIPTION OF THE PREFERRED EMBODIMENTS

Best modes of carrying out the present invention will be described in further detail using various embodiments with reference to the accompanying drawings. In the present invention, to drive a display panel by using a plurality of panel driving means, configurations are built in where a signal for driving control can be transferred between specified panel driving means out of the plurality of panel driving means. When an abnormality in display control is detected by one panel driving means, the detected result is transferred to the other panel driving means which is exerting normal display control and a normal signal is transferred from the other panel driving means to the one panel driving means that has detected the abnormality and the one panel driving means uses the normal signal transferred from the other panel driving means for control of displaying.

First Embodiment

Figure 1:
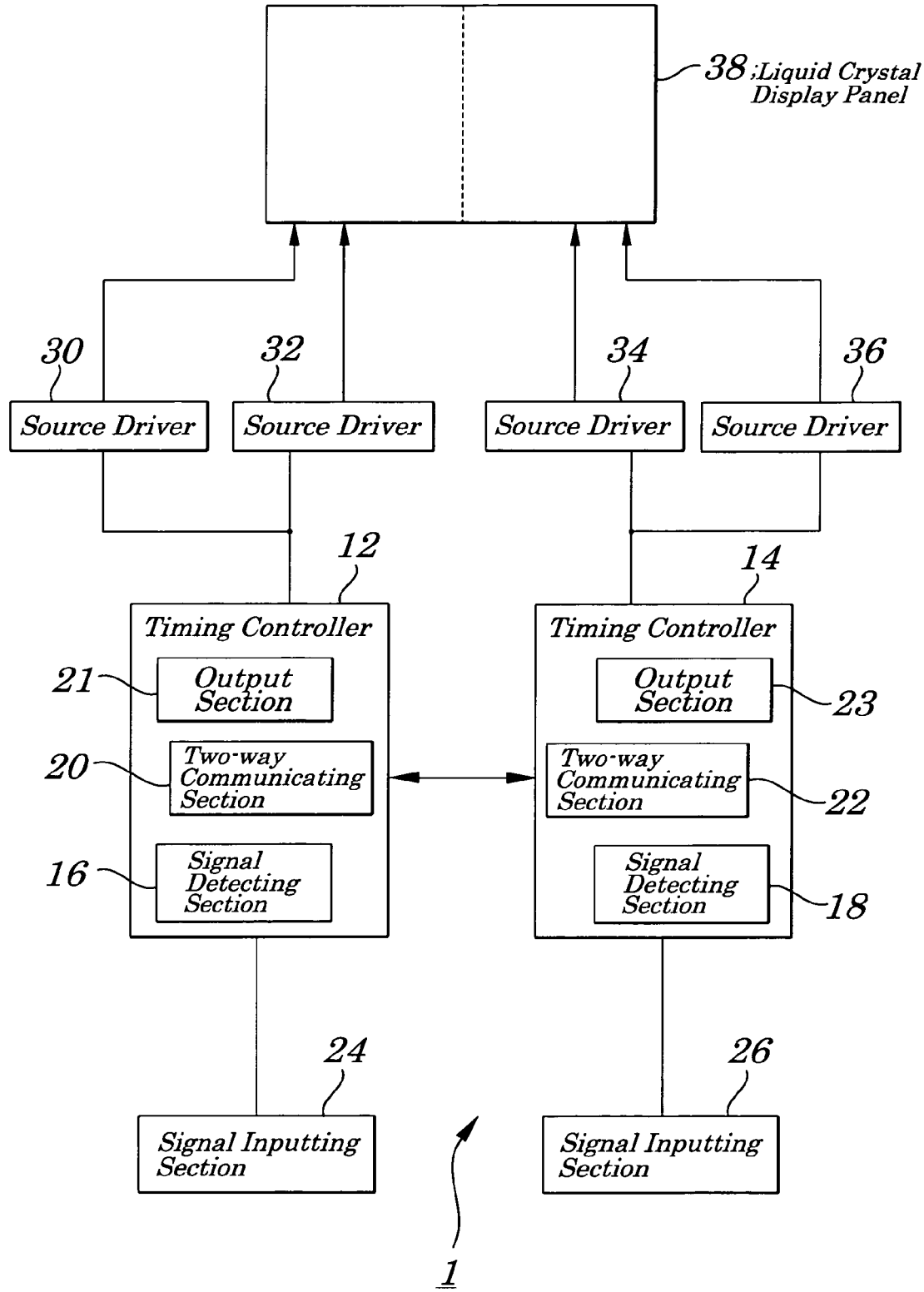
FIG. 1 is a block diagram showing electrical configurations of a driving device for a liquid crystal display panel according to a first embodiment of the present invention.
Figure 2:
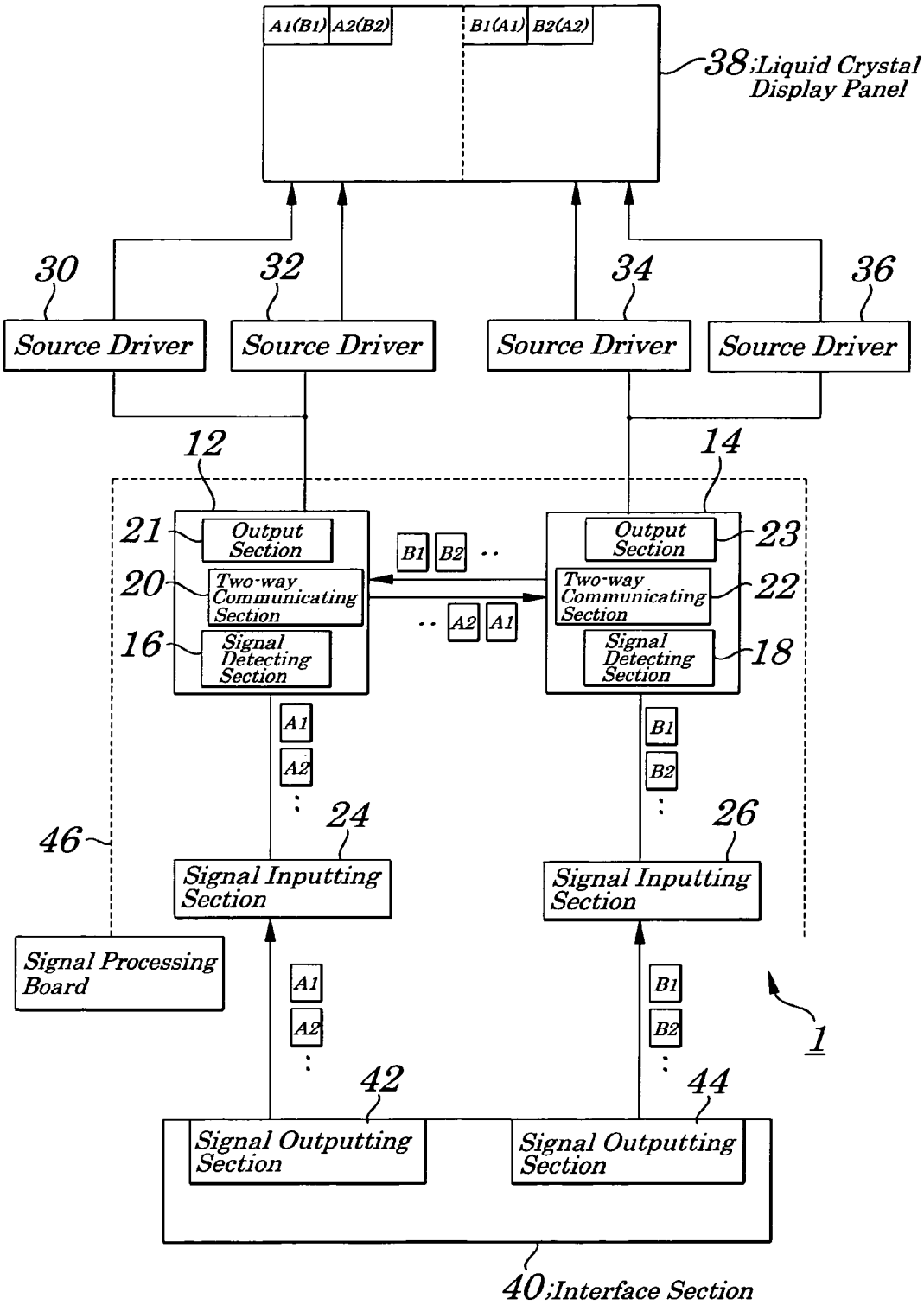
FIG. 2 is a diagram explaining operations of the driving device of FIG. 1.

FIG. 1 is a block diagram showing electrical configurations of a driving device 1 for a liquid crystal display panel according to a first embodiment of the present invention. FIG. 2 is a diagram explaining operations of the driving device 1 of FIG. 1. The driving device 1 of the first embodiment is constructed so as to include, as shown in FIG. 1, timing controllers 12 and 14, signal detecting sections 16 and 18, two-way communicating sections 20 and 22, and output sections 21 and 23 and so that the liquid crystal display panel 38 is driven by the two timing controllers 12 and 14 and, when an abnormality in display control is detected by one timing controller 12 or 14, the other timing controller 12 or 14 exerting normal display makes the one timing controller 12 or 14 exert normal display control according to a normal signal transferred from the other timing controller 12 or 14.

As shown in FIG. 2, a signal inputting section 24 is connected to a signal outputting section 42 of an interface section 40, whereas a signal inputting section 26 is connected to a signal outputting section 44 of the interface section 40. The timing controllers 12 and 14, signal inputting sections 24 and 26, and interface section 40 are all mounted on a signal processing board 46. As shown in FIG. 1, the timing controller 12 is connected to the signal inputting section 24 and the timing controller 14 is connected to the signal inputting section 26, while the timing controller 12 is connected to source drivers 30 and 32 and the timing controller 14 is connected to source drivers 34 and 36. As shown in FIG. 2, each of the source drives 30, 32, 34, and 36 is individually connected to a corresponding driving input terminal of the liquid crystal display panel 38.

Each of the source drivers 30, 32, 34, and 36 is connected to each of corresponding driving input terminals in a manner in which the source driver 30 drives the first one-quarter portion on a left side of the liquid crystal display panel 38, the source driver 32 drives the second one-quarter portion on the left side of the liquid crystal display panel 38, the source driver 34 drives the third one-quarter portion on the left side of the liquid crystal display panel 38, and the source driver 36 drives the fourth one-quarter portion on the left side of the liquid crystal display panel 38.

Each of the signal detecting sections 16 and 18 detects a state of an input signal (image signal) and/or control signal (clock signal or a like) fed from each of the signal inputting sections 24 and 26 respectively. The two-way communicating section 20 or 22 transfers a detected result fed from the signal detecting section 16 or 18 of one timing controller 12 or 14 to which each of the two-way communicating section 20 or 22 belongs and transfers a normal image signal and/or normal control signal generated by the other timing controller 12 or 14 to the one timing controller 12 or 14. The output section 21 or 23, when the detected result from the signal detecting sections 16 or 18 shows that a signal to be used for display control is abnormal, for example, an abnormality that states occur in which no signal is input and/or in which a supply of a clock signal is stopped, supplies, instead of the abnormal signal, a normal image signal (input signal) and/or normal control signal (clock signal or a like) fed from the two-way communicating sections 20 or 22 to each of the corresponding source drivers 30, 32, 34, and 36.

Next, operations to be performed in the first embodiment are described by referring to FIGS. 1 and 2. At time of normal displaying on the liquid crystal display panel 38, an input signal corresponding to a left half or a right half of a display screen is supplied from the signal inputting section 24 or 26 to the timing controller 12 or 14. Each of the input signals is converted by the timing controller 12 or 14 into an image signal with predetermined display timing and is applied through each of the corresponding source drivers 30, 32, 34, and 36 to a driving electrode of the liquid crystal display panel 38 and an image corresponding to the above image signal is displayed on the display screen of the liquid crystal display panel 38.

Such the display of images as described above can be achieved when an input signal and control signal are normally input from the signal inputting section 24 or 26 to the corresponding timing controllers 12 or 14. However, if states occur in which no signal is input to the corresponding timing controller 12 or 14 from the signal inputting section 24 or 26 and/or in which an input control signal is abnormal, the abnormal signal state is detected by the corresponding signal detecting section 16 or 18. The detected result is supplied to the output section 21 or 23 and to the two-way communicating section 20 or 22 of the timing controller 12 or 14 (hereinafter referred to as "one timing controller 12 or 14") in which the abnormality is detected.

The two-way communicating section 20 or 22 in the one timing controller 12 or 14 notifies the two-way communicating section 20 or 22 in the other timing controller 12 or 14 of the occurrence of an abnormality and receives normal image signals (for example, B1, B2, . . . or A1, A2, . . . ) and/or normal control signals (for example, clock signals) from the two-way communicating sections 20 or 22 receiving there the normal image signal and/or the normal control signal. Instead of the abnormal image signals and/or abnormal control signal output from the output section 21 or 23, the received normal image signals and/or normal control signals are output and supplied to the liquid crystal display panel 38.

By configuring as above, even if an abnormality occurs in display control of one timing controller 12 or 14, normal driving of the liquid crystal display panel 38 can be continued and application of a DC (Direct Current) component to the liquid crystal display panel 38 can be avoided, which results in preventing the liquid crystal display panel 38 from deteriorating. Moreover, images can be displayed without constraints of a format on the interface section side.

Thus, according to the first embodiment, a detected result indicating an abnormality in display control in one timing controller is transferred from the one timing controller to the other timing controller exerting normal display control and normal image signals and/or normal control signals are transferred from the other timing controller to the one timing controller so that the one timing controller in which the abnormality has occurred in the display control can utilize the transferred normal image signals and/or the normal control signals for display control in order to continue to drive a liquid crystal display panel and, therefore, normal display on the liquid crystal display panel is realized and application of a DC component to the liquid crystal display panel can be avoided which results in preventing the liquid crystal display panel from deteriorating, and image display without constraints of a format on the interface section side can be achieved.

Second Embodiment

Figure 3:
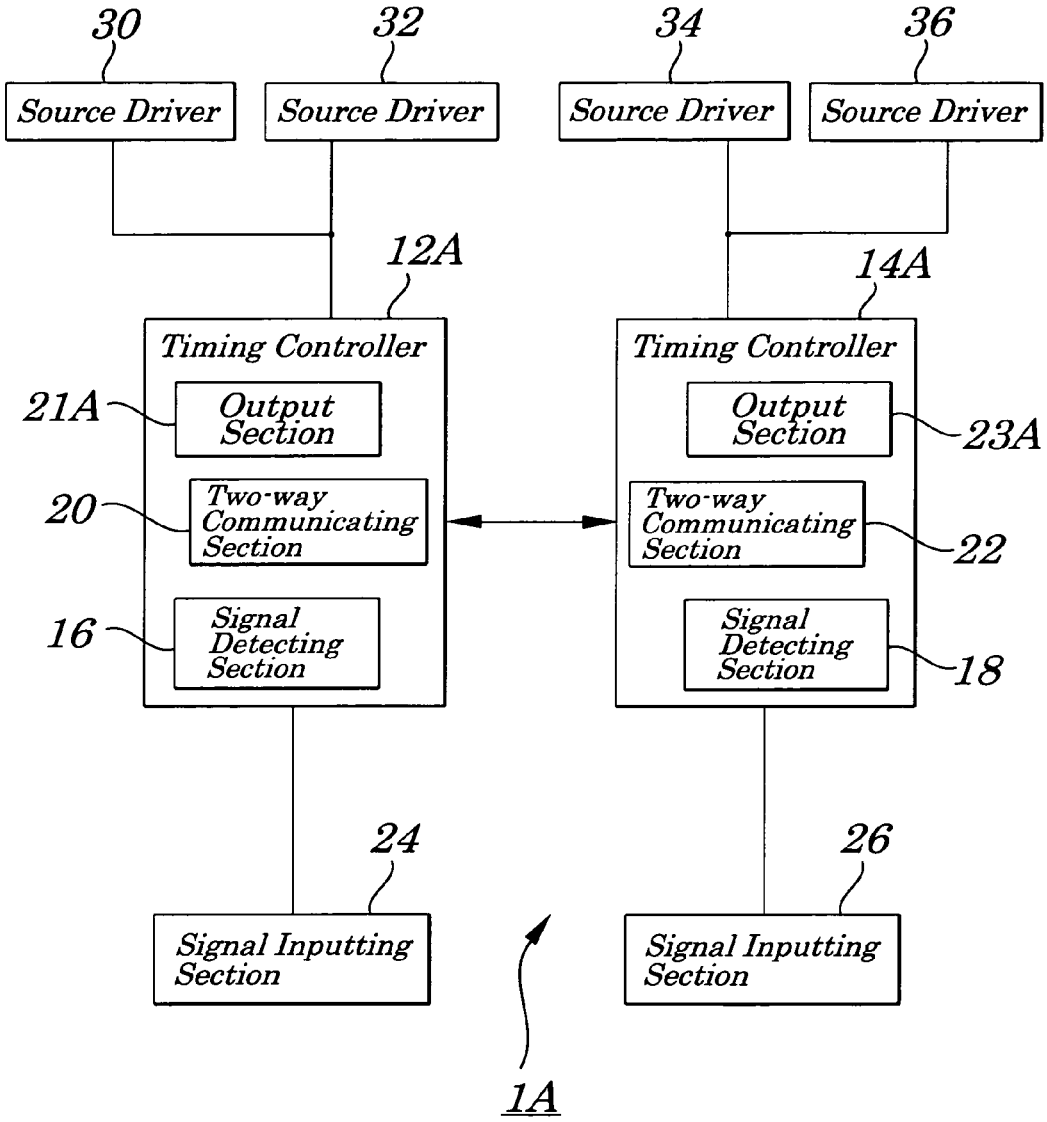
FIG. 3 is a block diagram showing electrical configurations of a driving device for a liquid crystal display panel according to a second embodiment of the present invention.

FIG. 3 is a block diagram showing electrical configurations of a driving device 1A for a liquid crystal display panel according to a second embodiment of the present invention. Configurations of the driving device of the second embodiment differ from those described in the first embodiment in that predetermined display data is preset to each of the two timing controllers and, when an abnormality in display control is detected by one timing controller, the other timing controller is notified of the detected result and, based on the detected result notified, the predetermined display data (image data) and/or control signals are transferred from the other timing controller to the one timing controller and are used by the one timing controller having detected the abnormality.

That is, the driving device 1A of the liquid crystal display panel of the second embodiment, as shown in FIG. 3, is constructed so that output sections 21A and 23A are provided in timing controllers 12A and 14A respectively and so that each of the output sections 21A and 23A is configured so as to be able to output predetermined display data and so that, when the signal detecting section 16 or 18 detects an abnormality in display control in one of the timing controllers 12A an 14A, for example, the abnormality that no signal is input and/or a supply of a control signal such as a clock signal or a like is stopped, the other timing controller 12A or 14A is notified of the detected result and, based on the detected result notified, the predetermined display data (image data) and/or normal control signals are transferred from the one timing controller 12A or 14A to the other timing controller 12A or 14A and the predetermined display data and/or control signals are supplied from the output section 21A or 23A of the one timing controller 12A or 14A to each of the source drives 30 and 32, or each of the source drivers 34 and 36 so as to be utilized for display control of corresponding portions of the liquid crystal display panel 38.

Configurations other than described above are the same as those in the first embodiment and same reference numbers are assigned to components having the same functions as in the first embodiment and their descriptions are omitted.

Next, operations to be performed in the second embodiment are described by referring to FIG. 3. As in the case of the first embodiment, at time of normal displaying on the liquid crystal display panel 38, input signals (image signals) corresponding to a left half or a right half of a display screen are supplied from the signal inputting section 24 or 26 to the timing controllers 12A or 14A. The input signals are converted by the timing controllers 12A or 14A into image signals with predetermined display timing and are applied through each of the corresponding source drivers 30, 32, 34, and 36 to a corresponding driving electrode of the liquid crystal display panel 38 and images corresponding to the above image signals are displayed on the display screen of the liquid crystal display panel 38.

In the operations of displaying images as above, when an abnormality in display control occurs in either one of the timing controllers 12A and 14A, for example, if an abnormality occurs that no signal is input from the signal inputting section 24 or 26 to the corresponding timing controller 12A or 14A or that a supply of a control signal such as a clock signal or a like is stopped, the abnormality in the display control is detected by the signal detecting section 16 or 18. The detected result is fed to the output section 21A or 23A and is notified through the two-way communicating section 20 or 22 to the other timing controller 14A or 12A. The other timing controller 12A or 14A having been notified of the detected result transfer preset display data and/or control signals to the one timing controller 12A or 14A according to the detected result. The output section 21A or 23A of the one timing controller 12A or 14A outputs the transferred display data and/or control signals, instead of signals indicating abnormal display control, to corresponding source drivers 30, 32, 34, and 36 of the liquid crystal display panel 38. By configuring as above, even if an abnormality occurs in display control of one timing controller 12A or 14A, normal driving of the liquid crystal display panel 38 can be continued and application of a DC component to the liquid crystal display panel 38 can be avoided, which results in preventing the liquid crystal display panel 38 from deteriorating. Moreover, images can be displayed without constraints of a format on the interface section side.

Thus, according to the driving device of the second embodiment, at time of the occurrence of an abnormality in display control in one timing controller, preset display data and/or control signals are transferred from the other timing controller to the one timing controller so that the one timing controller can exert normal display control and, therefore, the same effect obtained in the first embodiment can be achieved in the second embodiment as well.

Third Embodiment

Figure 4:
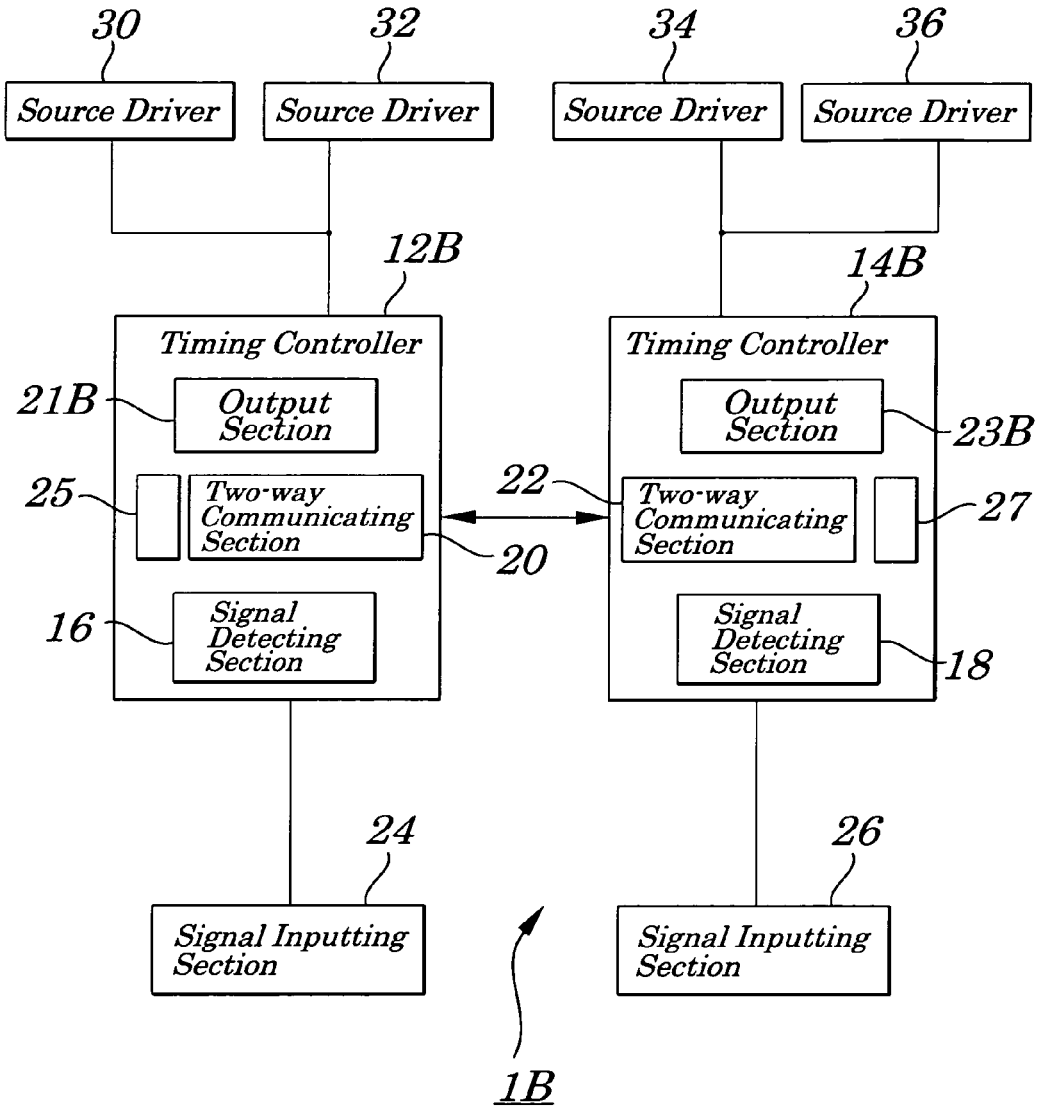
FIG. 4 is a block diagram showing electrical configurations of a driving device for a liquid crystal display panel according to a third embodiment of the present invention.
Figure 5:
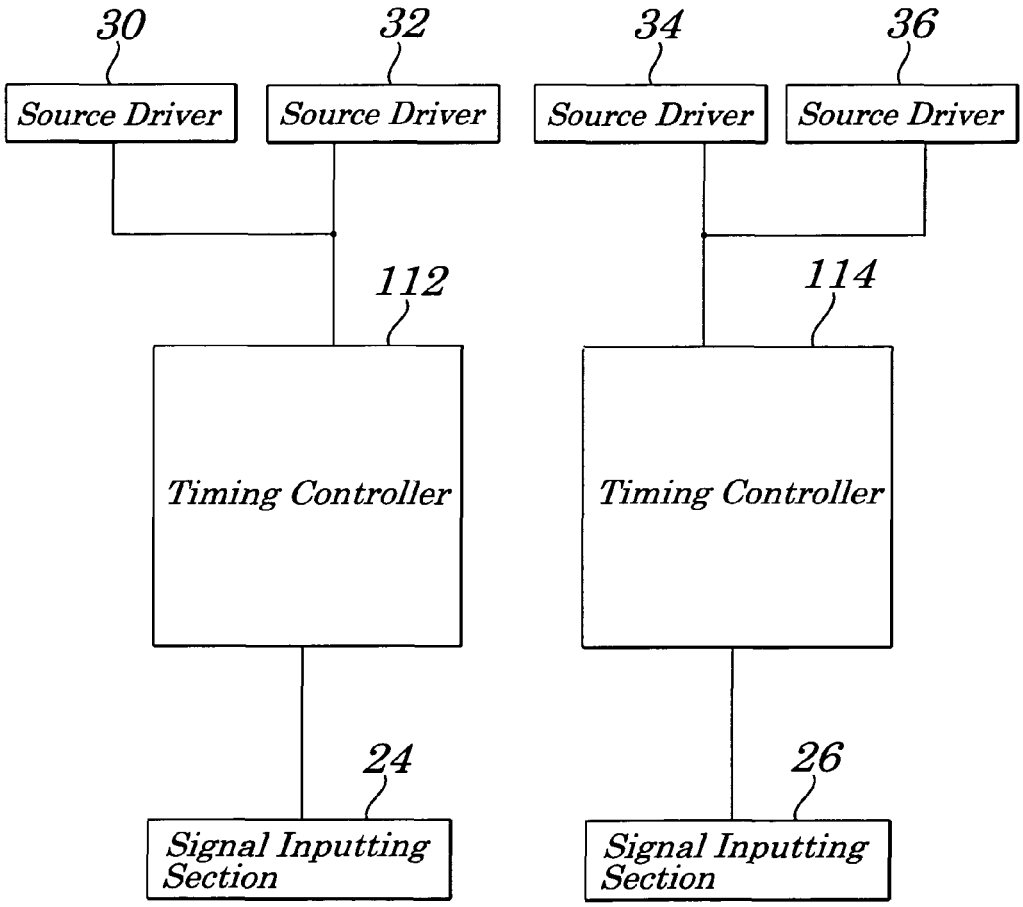
FIG.5 (PRIOR ART)
FIG. 5 is a block diagram showing electrical configurations of a conventional driving device for a liquid crystal display panel.

FIG. 4 is a block diagram showing electrical configurations of a driving device for a liquid crystal display panel according to a third embodiment of the present invention. Configurations of the driving device of the third embodiment differ from those of the first embodiment in that a memory storing predetermined image data is mounted on each of two timing controllers and one timing controller detects an abnormality of its display control and notifies the other timing controller of the detected result and the other controller transfers image data and/or control signal to the one timing controller to make the one controller exert normal display control.

That is, the driving device 1B of a liquid crystal display panel 38 of the third embodiment is so constructed, as shown in FIG. 4, that a memory 25 or 27 is mounted on the timing controller 12B or 14B and predetermined image data is stored in each of the memories 25 and 27 and that, when the signal detecting section 16 or 18 of one timing controller 12B or 14B, detects an abnormality in display control, for example, the abnormality that no signal is input and/or a supply of a control signal such as a clock signal or a like is stopped, the detected result is transferred through the two-way communicating section 20 or 22 to the other timing controller 12B or 14B and the other timing controller 12B or 14B reads, according to the detected result, the predetermined image data stored in advance in the memory 25 or 27 of the other timing controller 12B or 14B and transfers the image data and/or control signals through the two-way communicating section 20 or 22 of the other timing controller 12B or 14B to the one timing controller 12B or 14B and the one timing controller 12B or 14B outputs the transferred image data and/or control signals, instead of signals indicating the abnormality in display control, from the output section 21B or 23B to the corresponding source drivers 30 and 32, or 34 and 36 of the liquid crystal display panel 38. Configurations other than above of the third embodiment are the same as those in the first embodiment and, therefore, same reference numbers are assigned to components having the same function as those in the first embodiment and their descriptions are omitted accordingly.

Next, operations to be performed in the third embodiment are described by referring to FIG. 4. At time of normal displaying on the liquid crystal display panel 38, as explained in the first embodiment, input signals corresponding to a left half or a right half of a display screen are supplied from the signal inputting section 24 or 26 to the timing controller 12B or 14B. The input signals are converted by the timing controller 12B or 14B into image signals with predetermined display timing and are applied through each of the corresponding source drivers 30, 32, 34, and 36 to a corresponding driving electrode of the liquid crystal display panel 38 and images corresponding to the above image signals are displayed on the display screen of the liquid crystal display panel 38.

In the displaying of images described above, when an abnormality occurs in display control in the timing controller 12B or 14B, for example, if the abnormality occurs that no image signal is input from the signal inputting section 24 or 26 to corresponding controller 12B or 14B or that a supply of a control signal (a clock signals or a like) is stopped, the abnormality in display control is detected by the signal detecting section 16 or 18. The detected result is fed to the output section 21B or 23B and to the two-way communicating section 20 or 22. The two-way communicating section 20 or 22 of one timing controller 12B or 14B transfers the detected result to the two-way communicating section 20 or 22 of the other timing controller 12B or 14B. The other timing controller 12*b* or 14B reads, according to the detected result, image data stored in its memory 25 or 27 and transfers the read image data and/or control signals through the two-way communicating section 20 or 22 of the other timing controller 12B or 14B to the two-way communicating section 20 or 22 of the one timing controller 12B or 14B.

Image data and/or control signals received by the two-way communicating section 20 or 22, instead of signals indicating the abnormality in display control, are output through the output section 21B or 23B to the source drivers 30 and 32 or 34 and 36 for display control. By configuring as above, even if an abnormality occurs in display control of one timing controller 12B or 14B, normal driving of the liquid crystal display panel 38 can be continued and application of a DC component to the liquid crystal display panel 38 can be avoided, which results in preventing the liquid crystal display panel 38 from deteriorating. By making the one timing controller 12B or 14B display transferred image data and by making the other timing controller 12B or 14B display image data stored in the memory 25 or 27, the same image can be displayed in left and right portions of the liquid crystal display panel 38.

Thus, according to the third embodiment, one timing controller detects an abnormality in display control and transfers the detected result to the other timing controller and the other timing controller transfers image data to the one timing controller for display control and, therefore, the same effect obtained in the first embodiment can be achieved as well. Moreover, by making the other timing controller transfer image data to one timing controller and by making the other timing controller display the transferred image data and by making the other timing controller display image data that the other timing controller has transferred to the one timing controller, the same image can be displayed in left and right portions of the liquid crystal display panel.

It is apparent that the present invention is not limited to the above embodiments but may be changed and modified without departing from the scope and spirit of the invention. For example, in the above embodiments, two timing controllers are employed, however, the driving device of the present invention may be constructed by using three or more timing controllers.

Also, in the above embodiments, states in which no image signal is input and/or a supply of a clock signal or a like is stopped are detected, however, the same avoidance of abnormal display as described above may be achieved by detecting other signal components contained in input image signals, for example, by detecting a frequency to make a check of input resolution.

Also, another example of the other signal component is a synchronization signal and abnormal display can be achieved by checking a synchronized condition of a synchronized signal and using the result from the checking.

Moreover, in the above embodiments, both the timing controllers cooperate only when an abnormality in display control occurs, however, the driving device of the present invention may be so constructed that both the timing controllers cooperate even when normal display control is being exerted.

Furthermore, the driving method and device of the present invention may be applied to various display devices for information processing devices, portable terminal devices, image cameras, television sets, or a like.

What is claimed is:

1. A driving method for driving a display panel, comprising:

providing a plurality of timing controllers, the timing controllers each driving in parallel as a whole a respective portion of the display panel;

a step in which, when any abnormality has occurred regarding inputting of an image signal and/or a control signal to an arbitrary timing controller, said arbitrary timing controller directly informs any one of other timing controllers of the occurrence of the abnormality via two-way communication between said arbitrary timing controller and the one of other timing controllers;

a step in which the one of other timing controllers directly transfers the image signal and/or the control signal to said arbitrary timing controller via the two-way communication when informed of the occurrence of the abnormality; and a step in which said arbitrary timing controller exerts a driving control of said display panel based on the image signal and/or the control signal received from the one of other timing controllers.

2. The driving method for driving the display panel according to claim 1, wherein said display panel comprises a liquid crystal display panel.

3. A driving method for driving a display panel, comprising:

providing a plurality of timing controllers, the timing controllers each driving in parallel as a whole a respective portion of the display panel;

a step of an arbitrary timing controller detecting any abnormality regarding inputting of an image signal and/or a control signal to said arbitrary timing controller;

a step of an arbitrary timing controller directly informing any one of other timing controllers of the detected result via two-way communication between said arbitrary timing controller and the one of other timing controllers;

a step of the one of other timing controllers directly transferring an image signal and/or a control signal to said arbitrary timing controller via the two-way communication in response to the informed detected result; and a step of said arbitrary timing controller exerting a driving control of said display panel based on the image signal and/or the control signal transferred from the one of other timing controllers.

4. The driving method for driving the display panel according to claim 3, wherein the image signal and/or the control signal to be transferred from the one of other timing controllers to said arbitrary timing controller is stored as data in a memory mounted on the one of other timing controllers.

5. The driving method for driving the display panel according to claim 3, wherein the image signal and/or the control signal to be transferred from the one of other timing controllers to said arbitrary timing controller is a signal to make fixed display appear on said display panel.

6. The driving method for driving the display panel according to claim 3, wherein the image signal and/or the control signal to be transferred from the one of other timing controllers to said arbitrary timing controller is a signal to make black fixed display appear on said display panel.

7. A driving device for driving a display panel, comprising:

a plurality of timing controllers, the timing controllers each driving in parallel as a whole a respective portion of the display panel, wherein when any abnormality has occurred regarding inputting of an image signal and/or a control signal to an arbitrary timing controller, said arbitrary timing controller directly informs any one of other timing controllers of the occurrence of the abnormality by means of two-way communication between said arbitrary timing controller and the one of other timing controllers, wherein the one of other timing controllers directly transfers an image signal and/or a control signal to said arbitrary timing controller via the two-way communication, when informed of the occurrence of the abnormality, and wherein said arbitrary timing controller exerts a driving control of said display panel based on the image signal and/or the control signal received from the one of other timing controllers.

8. The driving device for driving the display panel according to claim 7, wherein said display panel comprises a liquid crystal display panel.

9. A driving device for driving a display panel, comprising:

a plurality of timing controllers, the timing controllers each driving in parallel as a whole a respective portion of the display panel, wherein an arbitrary timing controller is configured to detect any abnormality regarding inputting of an image signal and/or a control signal to said arbitrary timing controller, wherein said arbitrary timing controller directly informs any one of other timing controllers of the detected result via two-way communication between said arbitrary timing controller and the one of other timing controllers, wherein the one of other timing controllers directly transfers an image signal and/or a control signal to said arbitrary timing controller via the two-way communication in response to the informed detected result, and wherein said arbitrary timing controller exerts a driving control of said display panel based on the image signal and/or the control signal received from the one of other timing controllers.

10. The driving device for driving the display panel according to claim 9, wherein the image signal and/or the control signal to be transferred from the one of other timing controllers to said arbitrary timing controller is stored as data in a memory mounted on the one of other timing controllers.

11. The driving device for driving the display panel according to claim 9, wherein the image signal and/or the control signal to be transferred from the one of other timing controllers to said arbitrary timing controller is a signal to make fixed display appear on said display panel.

12. The driving device for driving the display panel according to claim 9, wherein the image signal and/or the control signal to be transferred from the one of other timing controllers to said arbitrary timing controller is a signal to make black fixed display appear on said display panel.

13. The driving device for driving the display panel according to claim 9, wherein said display panel comprises a liquid crystal display panel.

14. A driving device for driving a display panel, comprising:

a plurality of timing controllers, the timing controllers each driving in parallel as a whole a respective portion of the display panel, wherein a means for arbitrary timing controlling detects any abnormality regarding inputting of an image signal and/or a control signal to said arbitrary timing controlling means, wherein said means for arbitrary timing controlling directly informs any one of other means for timing controlling of a detected result via two-way communication between said means for arbitrary timing controlling and the one of other means for timing controlling, wherein the one of other means for timing controlling directly transfers an image signal and/or a control signal to said means for arbitrary timing controlling via the two-way communication, in response to the informed detected result, and wherein said means for arbitrary timing controlling exerts a driving control of said display panel based on the image signal and/or the control signal received from the one of other means for timing controlling.

15. The driving device for driving the display panel according to claim 14, wherein the image signal and/or the control signal to be transferred from said the one of other means for timing controlling to said means for arbitrary timing controlling is stored as data in a memory mounted on the one of the other means for timing controlling.

16. The driving device for driving the display panel according to claim 14, wherein the image signal and/or the control signal to be transferred from said one of other means for timing controlling to said means for arbitrary timing controlling is a signal to make fixed display appear on said display panel.

17. The driving device for driving the display panel according to claim 14, wherein the image signal and/or the control signal to be transferred from said one of other means for timing controlling to said means for arbitrary timing controlling is a signal to make black fixed display appear on said display panel.

* * * * *